US005165695A

United States Patent [19]

Yoder

[11] Patent Number: 5,165,695

[45] Date of Patent: Nov. 24, 1992

[54] BAG TOSSING GAME

[76] Inventor: Thomas T. Yoder, 44763 Fair Oak Dr., Canto, Mich. 48187

[21] Appl. No.: 794,455

[22] Filed: Nov. 19, 1991

[51] Int. Cl.[5] ..... A63B 63/00

[52] U.S. Cl. ..... 273/402

[58] Field of Search ..... 275/402, 400, 401, 415

[56] References Cited

U.S. PATENT DOCUMENTS

| | | | |
|---|---|---|---|
| 285,396 | 9/1883 | De Windt | 273/402 X |
| 431,211 | 7/1890 | Merrill . | |
| 827,626 | 7/1906 | Gillet . | |
| 922,717 | 5/1909 | Parker | 273/401 |
| 1,279,654 | 9/1918 | Charlesworth | 273/401 X |
| 2,021,989 | 11/1935 | DeMaster | 273/401 |
| 2,291,104 | 7/1942 | Radzyner . | |
| 2,504,818 | 4/1950 | Findon | 273/402 |
| 3,139,281 | 6/1964 | Nicholson | 273/285 X |
| 3,480,280 | 11/1969 | Gamertsfelder . | |
| 3,554,550 | 1/1971 | Schraum . | |
| 3,628,793 | 12/1971 | Mudloff | 273/402 |
| 3,837,650 | 9/1974 | Haney | 273/402 |
| 4,116,443 | 9/1978 | Dorfman . | |
| 4,186,925 | 2/1980 | Goldfarb . | |
| 4,243,229 | 1/1981 | Huser | 273/402 |
| 4,323,250 | 4/1982 | Lansberry | 273/400 |
| 4,565,375 | 1/1986 | Dresel | 273/401 |
| 4,709,929 | 12/1987 | Mills | 273/402 |
| 4,726,591 | 2/1988 | Johnson | 273/402 X |
| 4,938,485 | 7/1990 | Hockridge | 273/401 |
| 4,943,065 | 7/1990 | DeLapa | 273/402 |
| 4,961,586 | 10/1990 | Conville | 273/402 |
| 4,968,041 | 11/1990 | Calvo | 273/401 |
| 5,050,889 | 9/1991 | Walker | 273/402 |
| 5,056,797 | 10/1991 | Hockert et al. | 273/402 |

*Primary Examiner*—William H. Grieb

*Attorney, Agent, or Firm*—Harness, Dickey & Pierce

[57] ABSTRACT

A transportable bag tossing game for one or more players having multiple scoring methods. To play the game, a single target structure or a pair of target structures are positioned on a sporting plane such as the ground such that a certain amount of space is provided between the player tossing the bag and that player's target structure. Each target structure is comprised of a single injection molded part having a first wall disposed relatively perpendicular to the supporting plane and an angled second wall having an aperture located along the central longitudinal axis of the target structure. The object of the game is to direct projectiles through an aperture contained on the second wall. The first planar wall is provided with a slot located proximate to a first end thereof to faciltate transporting the target structure. When two or more players are involved, a second target structure is provided, having the same dimensions as the first target structure, except that the slot contained on the second wall is positioned such that when the first and second target structures are in a stacked relationship, the slots are in axial alignment to facilitate transporation of both target structures.

15 Claims, 1 Drawing Sheet

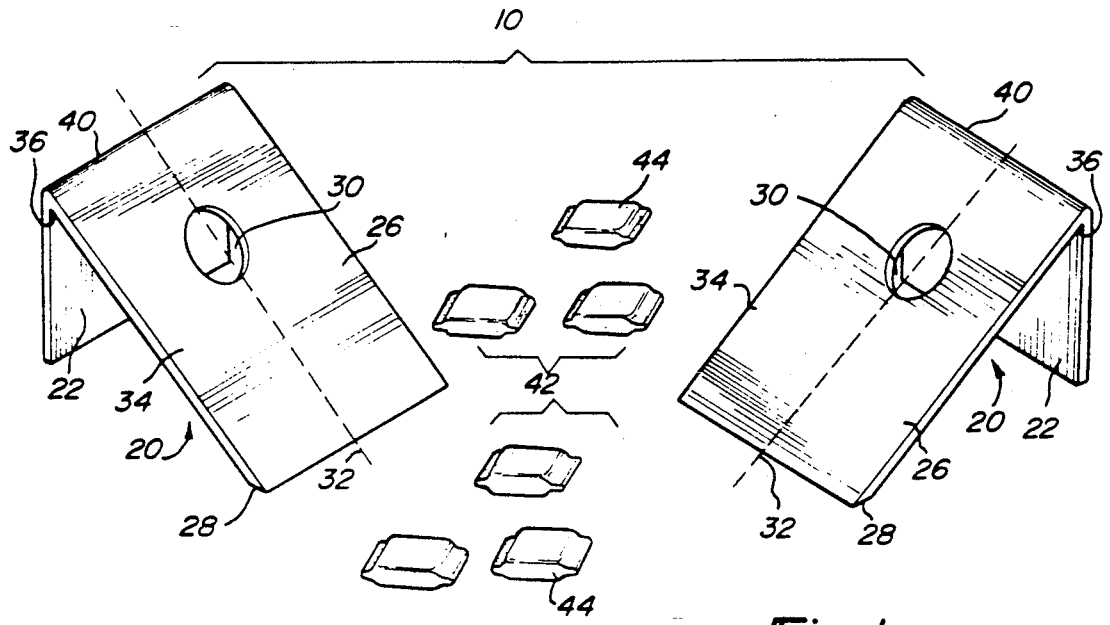
Fig-1
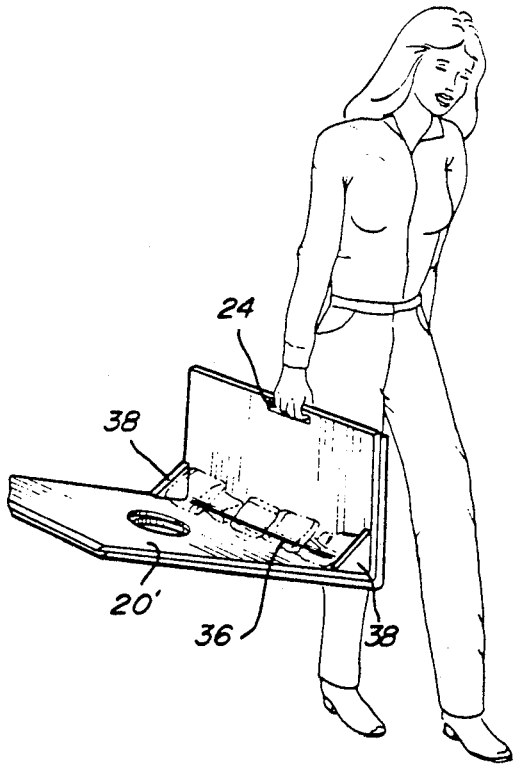
Fig-2
Fig-3
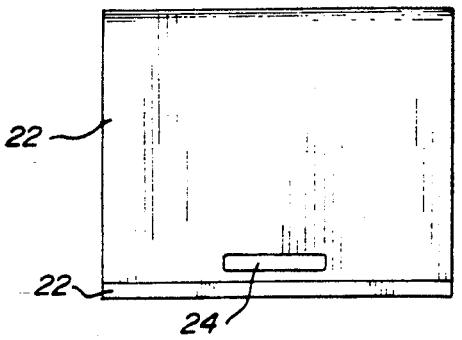

BAG TOSSING GAME

BACKGROUND OF THE INVENTION

1. Field of the Invention

The present invention relates to a transportable bag tossing game for one or more players having the possibility of multiple scoring methods. More particularly, the present invention relates to a transportable bag tossing game including one or more target structures, wherein each target structure has an inclined wall containing an aperture through which a bag filled with beans, popcorn, sand, pellets or other suitable materials must pass in order to score points.

2. Description of Related Art

A number of games involving the direction of a projectile at a target are known in the prior art. More particularly, tossing games involving a bean bag or other like structure at a target assembly having an inclined plane which includes an aperture for a target are known in the art. For example, U.S. Pat. No. 4,961,586 which issued Oct. 9, 1990 involves a tossing game for use by one or more players having a pair of module target assemblies deployed in a spaced apart relationship and having an inclined plane with an aperture through which soft bags are thrown to generate points in accordance with game rules. After playing, the target assemblies of the aforementioned patent can be dismantled and restructured so that the target assemblies can be coupled together for storage or transportation.

U.S. Pat. No. 4,943,065 which issued Jul. 24, 1990 also discloses a target structure for a bag tossing game. This structure comprises a target surface member having a target hole through it, wherein the target structure service has a smooth texture and is flexible to provide spring action so that when a bean bag strikes the surface, it may either slide or bounce depending upon on the angle of incidence at which the bag strikes the target surface. The dimensions of the target assemblies are such that the inclined portion of the target assembly is completely elevated off of the ground so that a bag cannot first strike the ground and thereafter slide up the target surface and through the aperture.

The prior art does not appear to provide a transportable bag tossing game which includes a pair of molded plastic one-piece target structures which can be readily stacked in a contiguous overlapping manner and transported without latching or snapping the target structures together. Further the prior art does not appear to provide for transporting the bags without physically attaching the bags to the target structure or placing them within a fully enclosed containment area within the target structure.

Accordingly, it is the primary object of the present invention to provide a transportable game having one-piece target structures which are stackable and do not require assembly prior to use.

It is another object of the present invention to provide a transportable game which is capable of being played indoors or outdoors.

It is another object of the present invention to provide a transportable game which can have various scoring methods.

It is another object of the present invention to provide a transportable game which is suitable for play by children and adults.

It is yet another object of the present invention to provide target structures which are economical to manufacture and which are durable.

Yet another fundamental object of the present invention is to provide a transportable bag toss game which is easily transported after use and provides means for carrying the bags which are used as projectiles.

SUMMARY OF THE INVENTION

To achieve the foregoing objects, the present invention provides a pair of first and second target structures made of molded plastic wherein each target structure has equal height, width, length and thickness dimensions. Each target structure is provided with a first wall disposed relatively perpendicular to a supporting plane and a second wall extending from the first wall at a downward angle. The first wall is provided with a slot proximate to a first end of the wall which serves as a carrying handle. The second wall is provided with an aperture through which the projectile bags are to be directed to score points according to the rules of the game. The angle formed between the first and second walls is generally in the range of between about 60–70.5 degrees. The surface of the second wall is smooth so that the bag striking the surface can slide up or down the second wall to possibly pass through the aperture.

The projectile bags which are utilized may be filled with beans, popcorn, sand, pellets made from plastic or rubber or any other suitable material. The covering used for the bags is made of a durable material such as nylon and is preferably waterproof. It is contemplated that the bags should weight approximately 10 ounces.

Additional objects and advantages of the present invention will become apparent from reading the detailed description of the preferred embodiments which make reference to the following set of drawings in which:

BRIEF DESCRIPTION OF DRAWINGS

FIG. 1 is a perspective view showing components comprising the transportable bag tossing game of the present invention.

FIG. 2 is a pictorial view of a player carrying the transportable game components wherein the target structures are inverted and contiguously stacked.

FIG. 3 is a rear view of the target structures in a stacked relationship showing the slots which serve as carrying handles.

DETAILED DESCRIPTION OF THE PREFERRED EMBODIMENTS

Referring to FIG. 1, a perspective view showing the components comprising the transportable bag tossing game 10 of the present invention is shown. A pair of first and second target structures 20 having equal height, width, length and thickness are separately disposed. Due to the many similarities between the first and second target structures, identical reference numerals will be used for similar components. The target structures 20 are positioned upon a supporting plane such as the ground or a floor. It is contemplated that the pair of target structures will be spaced approximately 20 feet apart for adults and closer together for children. One or more players direct the bags 42 toward a target structure 20 in an attempt to direct the bags 42 through the aperture 30 contained on the inclined wall 26 of the target structure. The bags 42 may be filled with beans, popcorn, sand, pellets formed of plastic or rubber, or any other suitable material. Each bag 42 weighs approximately 10 ounces and is provided with a durable cover 44 such as nylon. Ideally, the material covering the bag 42 will have water repellent qualities to preclude agglomeration of the contents of the bag.

The target structures 20 comprise a first wall 22 disposed relatively perpendicular to the supporting plane and a second wall 26 which extends downwardly at an angle from the first wall 22 thereby providing the target structure 20 with an inclined target surface 34. The first wall 22 is relatively square in shape and is provided with a slot 24 located proximate to the base 28 of the first wall 22 which serves as a handle for transporting the target structures 20. The second wall 26 is provided with an aperture 30 located along the central longitudinal axis 32 which serves as the target for the bags 42. The outer surface 34 of the second wall 26 is generally very smooth to allow the bags 42 to move up or down the outer surface 34 depending on the trajectory and velocity at which the bag is directed upon the outer surface.

Each of the target structures 20 are formed from a molded plastic such as high density polystyrene or polypropylene. A key feature of the present invention is that the target structure 20 is a one-piece assembly which does not contain hinges, thereby eliminating the requirement of assembly or manipulation of the target structure to dispose it in a playable position. It is contemplated that the width of the target structure 20 will be between approximately 12 and 14 inches. The height of the first wall 22 will preferably be approximately 12 inches and the length of the second wall 26 will preferably be about 30 inches. The aperture 30 contained on the second wall 26 is preferably about seven inches in diameter and is located along the central longitudinal axis 32 of the second wall 26. The first end of the second wall 26 is tapered so that the base 28 of the second wall 26 can rest contiguously upon a flat supporting plane. Preferably, the aperture 30 is disposed proximate to the top 40 of target structure 20 so that approximately 65% of the length of the second wall 26 is disposed below the aperture 30.

Referring to FIG. 2, the first and second target structures are shown being transported by a player. The first target structure is contiguously positioned over the second target structure so that the slots 24 contained on both second walls are in axial alignment as more clearly shown in FIG. 3. The target structures 20 overlap such that the players may insert their fingers through the slots 24 and grasp the bottom edge of the first walls to transport the target structures 20. The second wall 26 of the target structures 20 are generally disposed away from the body of the player transporting the target structures. The underside of each target structure is formed with a crease 36 at the point where the first and second walls branch. In one embodiment of the present invention, the second target structure 20' is provided with first and second blocking walls 38 disposed within the crease 36. The blocking walls 38 are spaced apart such that a plurality of bags can be positioned within the crease 36 and transported without further attaching the bags 42 to the target structures 20. The blocking walls 38 serve an additional function in that they supply additional structural support to the target structure 20' and preclude the possiblity that the first and second walls could be undersirably forced together.

RULES OF PLAY

As noted, the game is played by one or more players. Generally there are two opposing players or two teams of opposing players. When there are two teams of two opposing adult players, one member of each team is positioned near one of the two target structures which have been spaced apart approximately 20 feet. Each team plays with a set of three bags wherein two opposing players alternate throws until both players have tossed all three bags. The objective is to be the first team to reach exactly 21 points by directing the bags through the aperture contained on the target structure positioned near that players teammate. One point is allotted for each bag tossed underhand through the aperture contained on the second wall of the target structure. The last player of the two opposing players to toss a bag through the aperture during his or her three tosses wins all the points for that tossing sequence. For example, if a first player penetrates the aperture on his/her target structure with their first throw and the opponent follows by making their penetrate the aperture and none of the players' remaining tosses do not penetrate the aperture, the opponent collects two points for that round. Even if a first player directs two or three of his/her bags through the aperture contained on their designated target structure, if the second player scores last, the second player collects all of the points for that sequence. It is therefore advantageous to be the last player to toss during any one tossing sequence. Bags which remain on the lip of the aperture or at the top of the target structure do not count as a point. However, if the bag slides through the aperture after hanging up on the lip of the aperture or at the top of the board, the point counts but only for the last player to penetrate their aperture during that tossing sequence. If a player or team of players exceeds 21 points during a turn, that player or team of players must deduct the points made during that turn from their previous score. The player or team of players wins only when exactly 21 points have been accumulated.

While the above description constitutes the preferred embodiments of the present invention, it will be appreciated that the invention is susceptible to modification, variation and change without departing from the proper scope and entire meaning of the accompanying claims.

I claim:

1. A transportable game for one or more players, having multiple possible scoring methods, comprising:

at least one projectile to be directed by said one or more players; and first and second one-piece target structure means positioned upon a supporting plane and having first and second relatively planar walls adjoining at an angle to form a crease, said first planar wall including a first end adaptable to abut said supporting plane, said first planar wall being disposed relatively perpendicular to said supporting plane and having a slot formed proximate to said first end operable to serve as a handle to facilitate transportation of said first target structure, said second planar wall including a first end adaptable to abut said supporting plane and having an aperture formed thereon through which said at least one projectile is to be directed, wherein the crease of said second one-piece target structure means includes first and second blocking walls, said crease being operable to store said at least one projectile between said first and second blocking walls when said second one-piece target structure is being transported in an inverted position.

2. The transportable game according to claim 1, wherein said first end of said second planar wall is tapered such that the base of said first end is substantially contiguous with said supporting plane.

3. The transportable game according to claim 1, wherein said first and second one-piece target structure means are comprised of plastic.

4. The transportable game according to claim 3, wherein in width of said one-piece target structure means is substantially similar to the height of said first wall.

5. The transportable game according to claim 4, wherein said aperture is located along the longitudinal central axis of said first wall.

6. The transportable game according to claim 5, wherein said first wall is provided with a smooth surface to allow said at least one projectile to slide thereon.

7. The transportable game according to claim 1, wherein the crease formed between said first and second walls has an angle within the range of between approximately 60–70.5 degrees with reference to said supporting plane.

8. A transportable game for one or more players having multiple scoring methods, comprising:

at least one projectile to be directed by said one or more players; and first and second one-piece target structures separately positionable upon a supporting plane, said first one-piece target structure being adapted to be contiguously stacked upon said second one-piece target structure for transporting and storing said first and second target structures, said first one-piece target structure comprising first and second relatively planar walls adjoining at an angle to form a crease, said first planar wall being disposed relatively perpendicular to said supporting plane and having a slot formed proximate to said first end, said second planar wall having an aperture formed thereon through which said at least one projectile is to be directed, said second one-piece target structure comprising first and second relatively planar walls adjoining at an angle to form a crease, said first planer wall being disposed relatively perpendicular to said supporting plane and having a slot formed proximate to said first end such that when said first and second target structures are contiguously stacked said slot of said first target structure is in axial alignment with slot of said second target structure, said second planar wall having an aperture formed thereon through which said at least one projectile is to be directed, said crease of said second one-piece target structure including first and second blocking walls, said crease being operable to store said at least one projectile between said first and second blocking walls when said second target structure is being transported in an inverted position.

9. The transportable game of claim 8, wherein the first end of the second planar wall of both said first and second target structures are tapered such that the base of said second planar walls is substantially contiguous with said supporting plane.

10. The transportable game of claim 9, wherein said first and second target structures are comprised of plastic.

11. The transportable game of claim 10, wherein the width of said first and second target structures is substantially equal to the height of said first wall of said first and second target structures.

12. The transportable game of claim 11, wherein the apertures of said first and second target structures are located along the longitudinal central axis of said first planar wall.

13. The transportable game of claim 12, wherein the first wall of said first and second target structures is provided with a smooth surface to allow said at least one projectile to slide thereon.

14. The transportable game of claim 8, wherein the crease formed between said first and second planar walls has an angle which is substantially equivalent for both said first and second target structures, said angle being in the range of between approximately 60–70.5 degrees with reference to said supporting plane.

15. The transportable game of claim 8, wherein said at least one projectile comprises a first set and a second set of projectiles, said first set of projectiles having a color distinct from the color of said second set of projectiles.

* * * * *